United States Patent [19]

Burnell et al.

[11] Patent Number: 4,981,219

[45] Date of Patent: Jan. 1, 1991

[54] APPARATUS AND METHOD FOR SEPARATING INTERMIXED PARTICLES OF DIFFERING DENSITIES

[76] Inventors: Garry J. Burnell, 120 Cormack Street, Cairns, Qld., Australia, 4870; Wayne J. Brown, 8 David Muir Street, Slade Point, Australia, 4741

[21] Appl. No.: 288,482

[22] Filed: Dec. 22, 1988

[30] Foreign Application Priority Data

Dec. 23, 1987 [AU] Australia ..... PI6046

[51] Int. Cl.[5] ..... B03B 5/58

[52] U.S. Cl. ..... 209/453; 209/211; 239/461

[58] Field of Search ..... 709/451–453, 709/208, 210, 211, 155, 157, 479; 239/461; 366/36, 43

[56] References Cited

U.S. PATENT DOCUMENTS 489,197 1/1893 Peck ..... 209/453
2,464,478 3/1949 Auer ..... 209/157
2,695,133 11/1954 Drury ..... 209/453

FOREIGN PATENT DOCUMENTS 2133722 8/1984 United Kingdom ..... 209/210
8604269 7/1986 World Int. Prop. O. ..... 209/453

*Primary Examiner*—Donald T. Hajec
*Attorney, Agent, or Firm*—Poms, Smith, Lande and Rose

[57] ABSTRACT

Apparatus and method for separating intermixed particles of differing densities including a separator bowl rotatable about an axis inclined to the horizontal plane and having a base wall and a peripheral wall, and a plurality of radially-spaced chambers disposed around the peripheral wall and extending from adjacent the base wall to the upper edge of the peripheral wall, each of the chambers having chamber walls converging with one another away from the axis to a discharge port at a height intermediate the base wall and the upper edge. The bowl is rotated and a mixture of the particles is fed into the lower portion of the bowl and the mineral particle fraction discharged from the discharge port of the bowl is collected.

9 Claims, 4 Drawing Sheets

APPARATUS AND METHOD FOR SEPARATING INTERMIXED PARTICLES OF DIFFERING DENSITIES

BACKGROUND OF THE INVENTION

This invention relates to separation apparatus.

This invention has particular but not exclusive application to the separation of heavy minerals from alluvial material and other ore materials, and for illustrative purposes reference will be made to such application. However, it is to be understood that this invention could be used in other applications, such as pollution control.

Simple methods of separating particles of heavy minerals such as gold or tin from alluvial deposits rely on the difference in gravitational forces to separate the heavy minerals from the lighter minerals while the mixture is being agitated. The simplest device of this kind is the panning dish, and the sluice box also utilises this principle.

DESCRIPTION OF THE PRIOR ART

Improved separation can be obtained if centrifugal effects are employed, as centrifugal forces on particles can typically be fifty to one hundred times the gravitational force on the particles. Centrifugal separation apparatus is known, but available equipment suffers from the problem that it cannot be operated as a processing device with continuous feed and discharge. The heavy minerals collect in traps within the centrifuge bowl, and operation must cease while they are flushed into a collection chamber.

SUMMARY OF THE INVENTION

The present invention aims to alleviate the above disadvantages and to provide separation apparatus which will be reliable and efficient in use. Other objects and advantages of this invention will hereinafter become apparent.

With the foregoing and other objects in view, this invention in one aspect resides broadly in centrifugal separation apparatus for separating intermixed particles of differing densities, said separation apparatus including:

- a separator bowl rotatable about a non-horizontal and having a base wall and a peripheral wall, and
- a plurality of radially-spaced chambers disposed around said peripheral wall and extending from adjacent said base wall to the upper edge of said peripheral wall, each of said chambers having chamber walls converging with one another away from said axis to a discharge port at a height intermediate said base wall and said upper edge.

Preferably, the upper edge is disposed at a greater diameter than the lower edge of the peripheral wall whereby centrifugal effects may result in material contained within the separator bowl passing upwardly along the peripheral wall.

Preferably, the peripheral wall is enclosed within an encompassing wall which extends from the base wall to the upper edge of the peripheral wall whereby a fluid enclosure is formed between the peripheral wall and the encompassing wall. Preferably there is provided a plurality of chamber apertures through the chamber walls such that fluid may pass from the fluid enclosure to the interior of the chambers although of course other fluid passage means, such as the formation of the chamber walls from mesh material, may be used if desired.

The chamber apertures may be formed as radial apertures passing through the chamber walls. It is preferred, however, that the chamber apertures be formed such that fluid flows in a substantially tangential direction between the fluid enclosure and the chambers.

Riffle plates may be provided in the form of a plurality of annular plates disposed within the peripheral wall and spaced apart along the axis of the separator bowl whereby direct flow of material from the base of the peripheral wall to the upper edge of the peripheral wall is interrupted.

The discharge ports may be formed as fixed apertures. Preferably, however, the discharge ports are formed as discharge apertures within each of which a selected control orifice spigot may be placed such that the flow rate at which material within the chamber may pass to a discharge chute may be controlled.

In a further aspect, this invention resides in a method of separating heavy mineral particles from lighter mineral particles, including:

- providing centrifugal separation apparatus having a separator bowl rotatable about a non-horizontal axis and having a base wall and a peripheral wall, said peripheral wall having a plurality of radially-spaced chambers extending from adjacent said base wall to the upper edge of said peripheral wall, each of said chambers having chamber walls converging with one another away from said axis to a discharge port at a height intermediate said base wall and said upper edge;
- rotating said separator bowl about said axis;
- feeding a mixture of mineral particles into the lower portion of said separator bowl, and
- collecting the mineral particle fraction discharged from said discharge port.

BRIEF DESCRIPTION OF THE DRAWINGS

In order that this invention may be more easily understood and put into practical effect, reference will now be made to the accompanying drawings which illustrate a preferred embodiment of the invention, wherein.

DESCRIPTION OF THE PREFERRED EMBODIMENT

Figure 1:
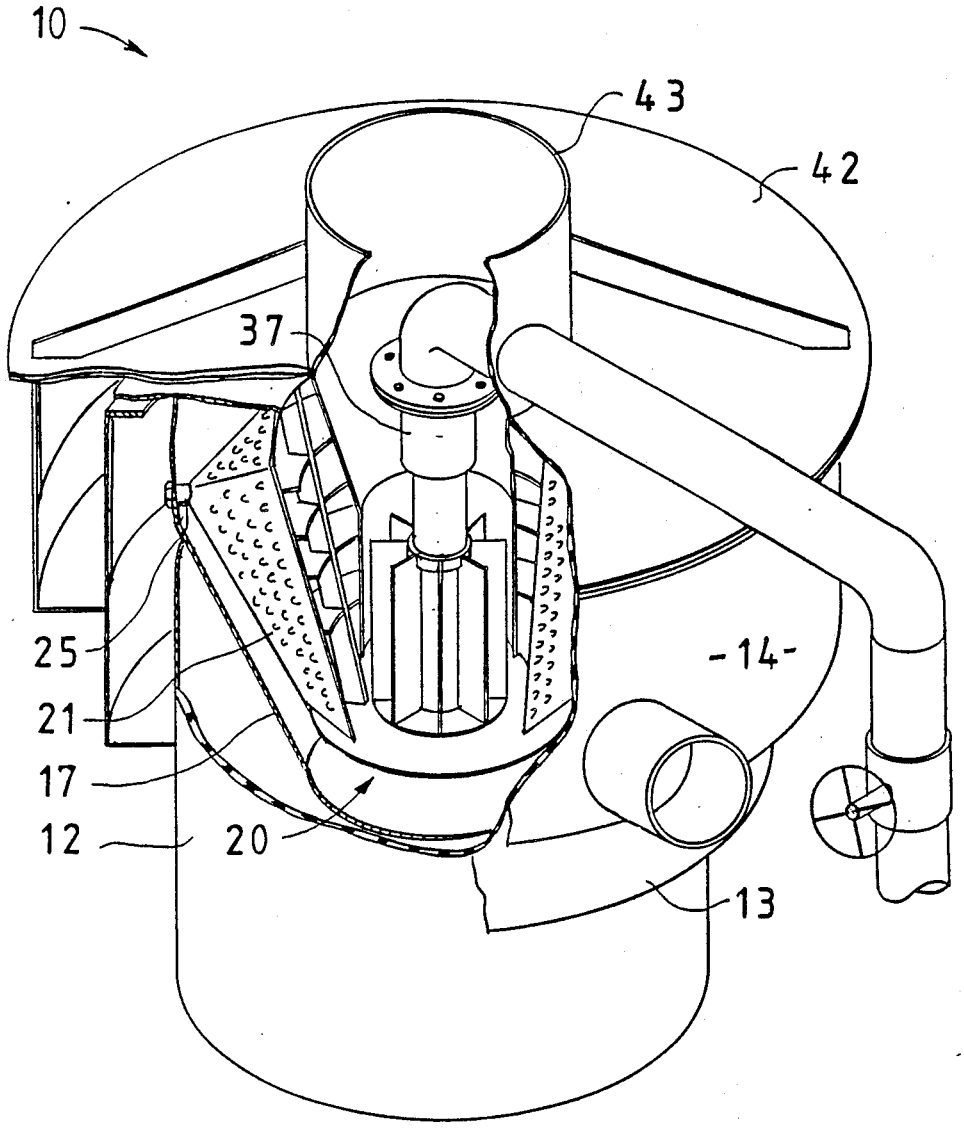
FIG. 1 is a pictorial view of a centrifugal separation apparatus according to the invention.
Figure 2:
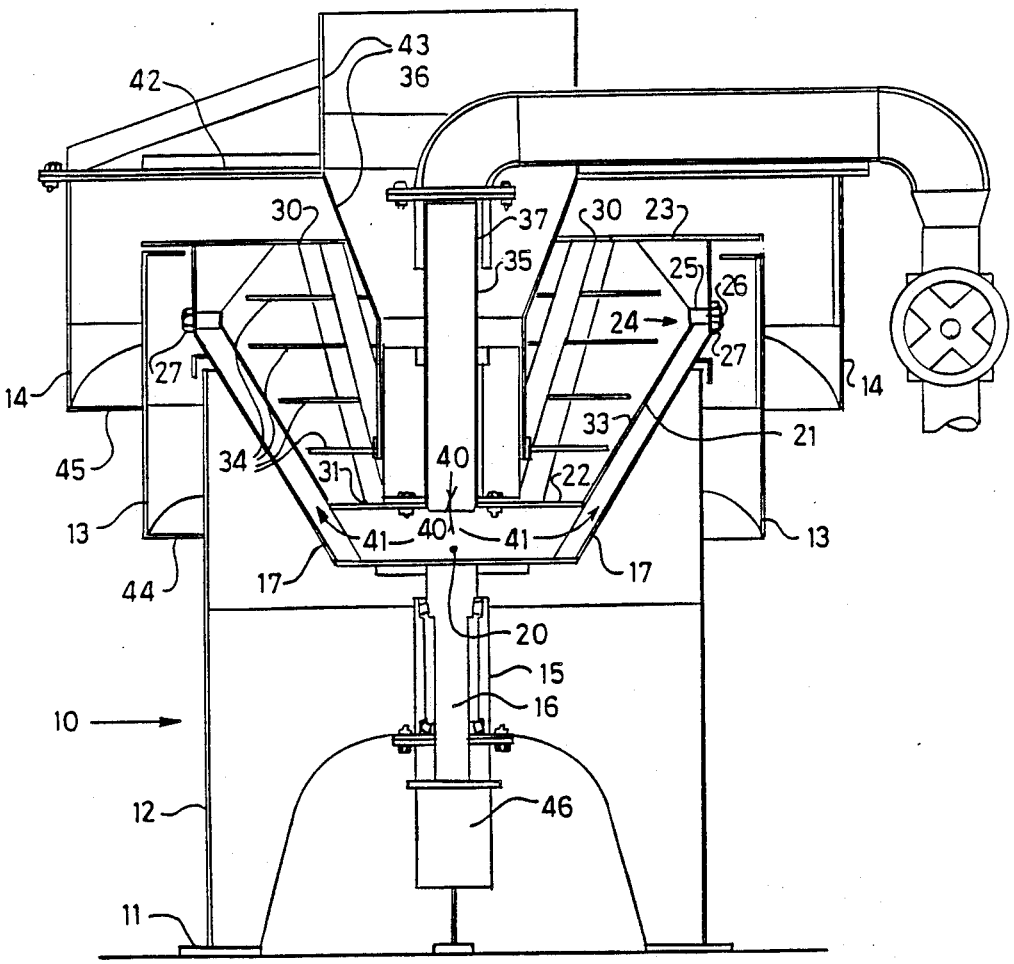
FIG. 2 is a sectional side view of the centrifugal separation apparatus.
Figure 3:
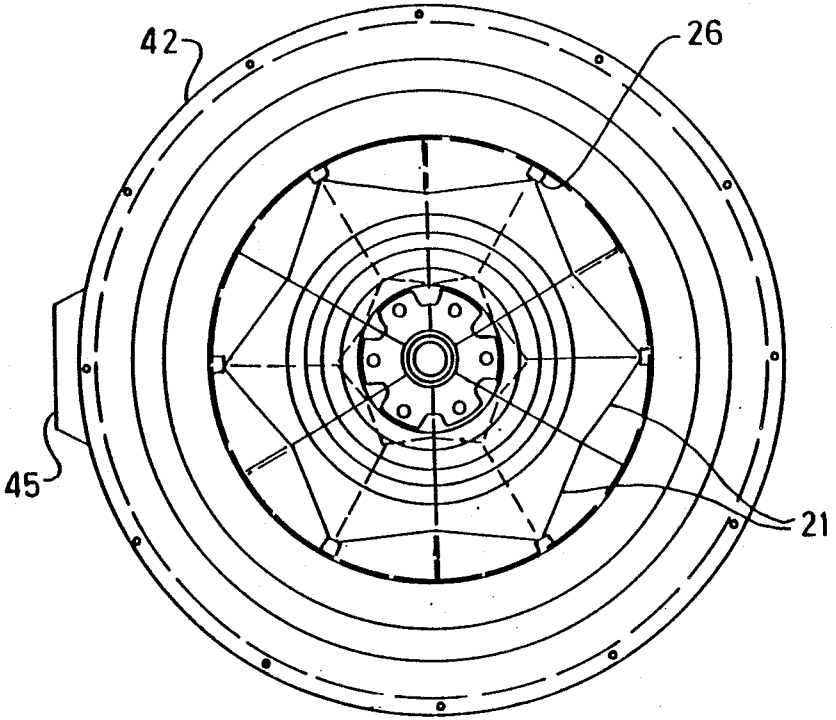
FIG. 3 is a sectional top view of the centrifugal separation apparatus.
Figure 4:
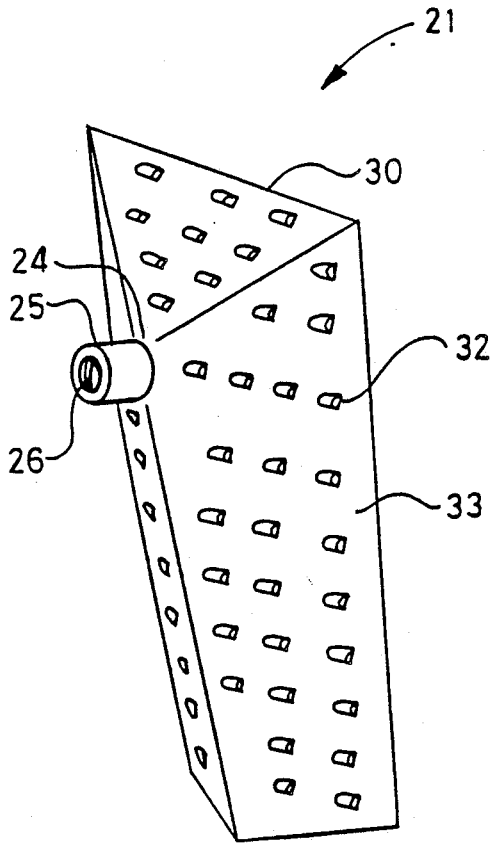
FIG. 4 is a pictorial view of a separator chamber.

The centrifugal separation apparatus 10 shown in FIGS. 1, 2, 3 and 4 is supported on a mounting base 11 by a base assembly 12 which carries a heavy minerals discharge chute 13 and a overflow discharge chute 14, both being in the form of inverted truncated cylinders with their axes coincident with a bearing assembly 15 which is also mounted within the base assembly 12. A bowl shaft 16 passes through the bearing assembly 15 and is attached at its upper end to a centrifugal bowl 17. A separator bowl assembly 20 is mounted within the centrifugal bowl 17 and rotates with it as a unit.

The separator bowl assembly 20 is formed as a plurality of separator chambers 21 which are spaced around the circumference of the separator bowl 20 and extend from the separator bowl base plate 22 upward to the separator bowl top plate 23. Each separator chamber 21 is pyramidal in shape with its open base facing the separator bowl axis and its apex 24 terminating in a discharge tube 25 which passes through the wall of the centrifugal bowl 17. A discharge orifice spigot 26 is placed within the discharge tube 25 to regulate the concentration ratio of the centrifugal separation apparatus 10. The upper edge 30 of each separator chamber 21 is located at a greater distance from the axis of the separator bowl 20 than the lower edge 31 such that the open base of the separator chamber 21 tapers upwards and outwards.

Each separator chamber 21 is formed with a plurality of wall apertures 32 in the chamber side walls 33. The wall apertures 32 are formed by pressing and lancing to produce projections on the outer sides of the chamber walls 33 with openings perpendicular to the chamber side walls 33. The openings are oriented towards the ends of the projections closest to the separator bowl axis, such that fluid entering a separator chamber 21 flows along the inner faces of the chamber side walls 33 toward the discharge tube 25.

Flat riffle plates 34 are mounted within the separator bowl 20, spaced axially along the separator bowl and increasing the size towards the top of the separator bowl 20. Triangular projections formed on the periphery of the riffle plates 34 project into, but do not contact, the separator bowl 20. The riffle plates 34 restrict free flow of material upward within the separator chambers 21.

A fluid supply pipe 35 is mounted at its base to the separator bowl 20 and projects upwards to join a fixed fluid pipe 36 at a rotary bearing and gland 37. Fluid passing through the fluid supply pipe 35 flows through the fluid discharge ports 40 into the fluid chamber 41 formed between the centrifugal bowl 17 and the separator chambers 21.

A cover plate 42 is attached to the top flange of the overflow discharge chute 14 and supports a feed tube 43 which is mounted coaxially with the separator bowl 20 and projects into the lower portion of the latter.

The heavy minerals discharge chute 13 terminates at its lower end in a heavy minerals outlet port 44, and the overflow chute 14 terminates at its lower end in an overflow outlet port 45.

A hydraulic motor 46 is mounted beneath the bearing assembly 15 on the base assembly 12. The hydraulic motor 46 has its drive shaft splined to the bowl shaft 16, and rotates the centrifugal bowl 17 and the separator bowl 20 about their common axis.

In use, the hydraulic motor 46 is energised to rotate the centrifugal bowl 17 and the separator bowl 20 about their axis at a speed of up to 500 rpm, or whatever speed is necessary to obtain the desired centrifugal force. Fluid is pumped into the fluid chamber 41 through the fluid supply pipe 35 and passes into the interior of the separator chambers 21 through the open bases thereof.

Fine-screened product material is introduced into the lower portion of the separator bowl 20 through the feed tube 43. Under the effect of the centrifugal forces, the alluvial material passes outward and upward over the riffle plates 34 and along the chamber side walls 33. The fluid flowing into the separator chambers 21 through the wall aperatures 32 agitates and fluidizes the product material.

The heavy minerals in the product material pass towards the discharge tubes 25, pass through the discharge orifices 26 and fall into the heavy minerals discharge chute 13. The lighter fractions of the product material are forced away from the outer portions of the separator chambers 21 and flow upward over the upper edges 30 of the separator chambers 21 and fall into the overflow chute 14. The ratio of flow from the discharge tubes 25 to flow through the overflow chute 14 may be adjusted to suit the concentration of heavy minerals in the alluvial material by adjusting the size of the orifices in the orifice spigots 26.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

We claim:

1. Centrifugal separation apparatus for separating intermixed particulate material of differing densities, and separation apparatus having a particulate material feeding means for introducing particulate material into the apparatus, and a separator bowl assembly rotatable about a substantially vertical bowl axis and including:

a base plate;

a top plate; and a plurality of substantially pyramidal shaped separator chambers each having an open base and an apex with a discharge port therein, each said separator chamber extending between said base plate and said top plate and being circumferentially disposed about said bowl assembly axis with their respective open bases facing said bowl assembly axis and the respective apexes thereof being the radially outermost portion thereof; wherein, upon rotation of said separator bowl assembly, intermixed particles of differing densities introduced via said feeding means and adjacent said base plate are separated with the heavier particles being discharged through the discharge ports in said apexes.

2. Centrifugal separation apparatus as claimed in claim 1, wherein the lighter particles discharge from said separator bowl assembly by passing over upper edges of each said separator chamber.

3. Centrifugal separation apparatus as claimed in claim 2, wherein both heavier and lighter particles discharge into respective discharge chutes.

4. Centrifugal separation apparatus as claimed in claim 3, wherein said plurality of circumferentially spaced separator chambers are disposed within a centrifugal bowl to form a fluid enclosure therebetween.

5. Centrifugal separation apparatus as claimed in claim 4, wherein each of said separator chambers have interconnected spaced side walls with a plurality of chamber apertures through said side walls.

6. Centrifugal separation apparatus as claimed in claim 5, wherein said chamber apertures are formed such that a fluid flows in a substantially tangential direction through said chamber apertures between said fluid enclosure and said separator chambers.

7. Centrifugal separation apparatus as claimed in claim 6, wherein there are provided riffle plates disposed within said separator bowl assembly and spaced apart along said bowl axis.

8. Centrifugal separation apparatus as claimed in claim 7, wherein respective orifice spigots are supported within the discharge ports in said apexes for regulating the concentration ratio of the apparatus.

9. A method for the separation of heavy minerals particles from lighter mineral particles, including:

providing centrifugal separating apparatus having a particulate material feeding means for introducing particulate matter into said apparatus, and a separate bowl assembly rotatable about a substantially vertical bowl axis and including a base plate, a top plate and a plurality of substantial pyramidal shaped separator chambers each having an open base and an apex with discharge port therein, each said separator chamber extending between said base plate and said top plate and being circumferentially disposed about said bowl axis with their respective apexes thereof being the radially outermost portion thereof;

introducing a mixture of light and heavy mineral particles within said separator bowl assembly via said feeding means and adjacent said base plate;

rotating said separator bowl assembly; and collecting the heavy mineral particles fraction discharged through the discharge ports in said apexes.

* * * * *